US010273768B2

(12) United States Patent
Montiel et al.

(10) Patent No.: US 10,273,768 B2
(45) Date of Patent: Apr. 30, 2019

(54) INDEXING DEVICE AND METHOD FOR A DUAL VALVE ASSEMBLY

(71) Applicant: Schlumberger Technology Corporation, Sugar Land, TX (US)

(72) Inventors: Edgar Montiel, Richmond, TX (US); Mark Smith, Alvin, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 69 days.

(21) Appl. No.: 15/317,000

(22) PCT Filed: Jun. 30, 2014

(86) PCT No.: PCT/US2014/044807
§ 371 (c)(1),
(2) Date: Dec. 7, 2016

(87) PCT Pub. No.: WO2016/003396
PCT Pub. Date: Jan. 7, 2016

(65) Prior Publication Data

US 2017/0114601 A1 Apr. 27, 2017

(51) Int. Cl.

| | |
|---|---|
| ***E21B 34/10*** | (2006.01) |
| ***E21B 23/00*** | (2006.01) |
| ***E21B 23/04*** | (2006.01) |

(52) U.S. Cl.
CPC ..... *E21B 23/004* (2013.01); *E21B 23/04* (2013.01); *E21B 34/10* (2013.01)

(58) Field of Classification Search
CPC ..... E21B 23/004
USPC ..... 166/374
See application file for complete search history.

(56) References Cited

U.S. PATENT DOCUMENTS

| | | | |
|---|---|---|---|
| 5,529,126 | A | 6/1996 | Edwards |
| 2001/0030049 | A1 | 10/2001 | Patel |
| 2007/0251697 | A1 | 11/2007 | Loretz et al. |
| 2012/0006553 | A1 | 1/2012 | Korkmaz |
| 2013/0105172 | A1 | 5/2013 | Swenson et al. |

OTHER PUBLICATIONS

PCT/US2014/044807 International Search Report, dated Mar. 27, 2015, 3 pgs.
International Preliminary Report on Patentability issued in the related PCT application PCT/US2014/044807 dated Jan. 3, 2017 (6 pages).

*Primary Examiner* — Taras P Bemko
(74) *Attorney, Agent, or Firm* — Cameron R. Sneddon

(57) ABSTRACT

In accordance to one or more aspects of the disclosure an indexing track for controlling a dual valve assembly includes a plurality of interconnected pressure-up and pressure-down slots that define sequence paths to translate the pin and to actuate the dual valve assembly to a first position when the pin is in a first track position, to a second position when the pin is in a mid-track position, and a third position when the pin is in a third track position.

15 Claims, 6 Drawing Sheets

INDEXING DEVICE AND METHOD FOR A DUAL VALVE ASSEMBLY

BACKGROUND

This section provides background information to facilitate a better understanding of the various aspects of the disclosure. It should be understood that the statements in this section of this document are to be read in this light, and not as admissions of prior art.

Hydrocarbon fluids such as oil and natural gas are obtained from a subterranean geological formation, referred to as a reservoir, by drilling a well that penetrates the hydrocarbon-bearing formation. Once a wellbore is drilled forms of well completion components may be installed in order to control and enhance efficiency of producing fluids from the reservoir. Some the equipment that is installed may make use of indexers for control.

SUMMARY

In accordance to one or more aspects of the disclosure an indexing track for controlling a dual valve assembly includes a plurality of interconnected pressure-up and pressure-down slots that define sequence paths to translate the pin and to actuate the dual valve assembly to a first position when the pin is in a first track position, to a second position when the pin is in a mid-track position, and a third position when the pin is in a third track position. In accordance to an aspect the indexing track may include a third position pressure-up slot extending in a first axial direction from the mid-track position to the third track position and a mid-track hold stop positioned axially between the third position pressure-up slot and the first track position to block axial movement of the pin in a second axial direction from the third position pressure-up slot to the first track position. In accordance to an aspect the indexing track is coupled with a flow control device. A method in accordance with an aspect includes translating the pin in a first axial direction from the first track position to the mid-track position, translating the pin from the mid-track position to the third track position, translating the pin in a second axial direction from the third track position to the mid-track position, and translating the pin from the mid-track position to the first track position.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
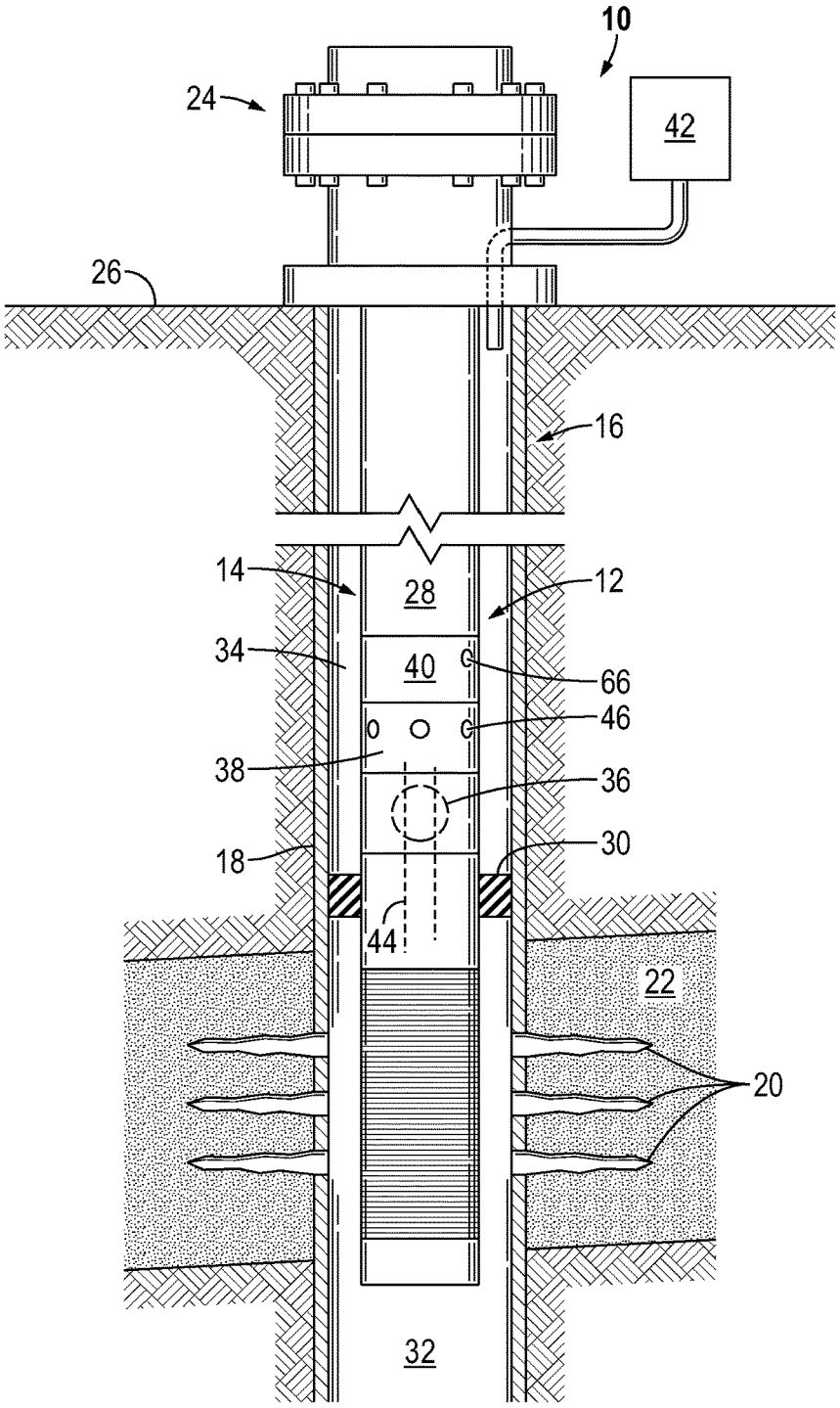
FIG. 1 illustrates a well system in which flow control devices and indexing tracks in accordance to aspects of the disclosure can be utilized.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface.

FIG. 1 illustrates a well system 10 in which a flow control valve, generally denoted by the numeral 12, can be utilized. The illustrated well system 10 includes a well completion 14 deployed for use in wellbore 16. Wellbore 16 may be lined with casing 18 for example having openings 20 (e.g., perforations, slotted liner, screens) through which fluid is able to flow between the surrounding formation 22 and wellbore 16. Completion 14 is deployed in wellbore 16 below a wellhead 24 disposed at a surface 26 (e.g., terrestrial surface, seabed).

Completion 14 includes flow control device 12 deployed in wellbore 16 on a conveyance 28, which is depicted and described herein as tubing 28. In FIG. 1 flow control device 12 is deployed with an annular barrier 30, e.g., packer. Packer 30 may act to isolate the well interval 32 below the packer from the hydrostatic head of fluid standing in the annulus 34 thereabove and flow control device 12 serves to permit or to prevent the flow of fluids to and from the isolated interval 32 through tubing 28.

Depicted flow control device 12 is a dual valve assembly that includes a lower valve 36, an upper valve 38, and a mechanical indexing device 40 operationally connected to both of the lower and the upper valve for example through a tool operator 48 (FIG. 2), for example mechanical link and/or hydraulic connection such as a slave and master cylinder. Lower valve 36 is operable between open and closed positions to control fluid flow through the bore 44 of tubing 28. Lower valve 36 is depicted as a ball valve in FIG. 1, however; other valve types may be utilized, for example a flapper valve. Upper valve 38 is a reverse or circulating valve that controls fluid communication radially between bore 44 and the wellbore, for example annulus 34, through radial ports 46 formed through the sidewall, e.g., outer housing, of the flow control device. For example, upper valve 38 may include a sleeve valve, disk valve, or other type of valve.

Valves 36, 38 are actuated between operating positions by indexing device 40, i.e., indexer or counter. Indexing device 40 includes an indexing track 50, e.g., FIGS. 4 to 11, to control the actuation of the dual valves of flow control device 12. Indexer 40 is actuated in response to cycling hydraulic pressure signals through a sequence of hydraulic pressure events. As will be understood by those skilled in the art with benefit of this disclosure, hydraulic pressure signals may be applied to indexer for example by a hydraulic source 42 (e.g., pump) which may be located for example at or above surface 26, for example on a marine platform or drilling vessel. Hydraulic pressure may be applied to the indexer 40 for example through wellbore annulus 34, through a control line, or through the tubing. In some embodiments the hydraulic pressure signal includes the application of hydraulic pressure and the removal of hydraulic pressure and the pressure change is associated with the change in direction of the pressure signal for example from pressuring up to bleeding down and from bleeding down to pressuring up.

Figure 2:
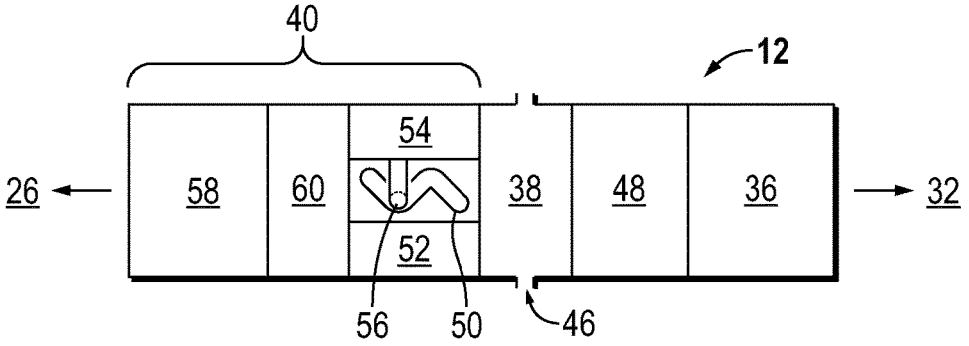
FIG. 2 schematically illustrates an example of a downhole flow control device in accordance with one or more aspects of the disclosure.
Figure 3:
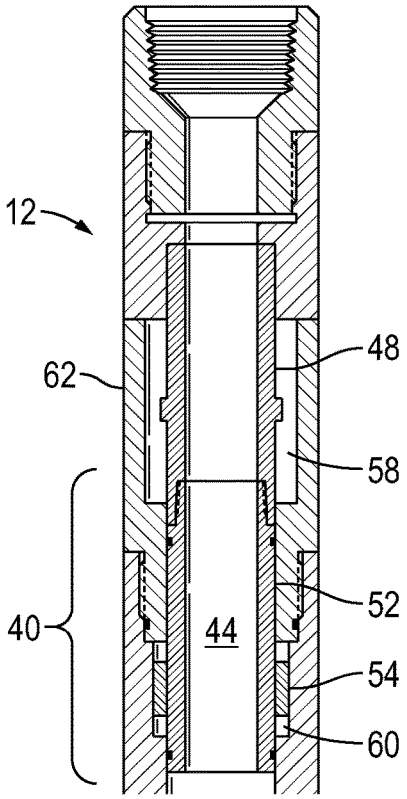
FIG. 3 illustrates an expanded view of a portion of a downhole flow control device in accordance to one or more aspects of the disclosure.

Referring in particular to FIGS. 2 and 3, flow control device 12 includes a mandrel 52 (e.g. cycle mandrel) disposed with a ring or sleeve 54. Cycle mandrel 52 and sleeve 54 are operationally connected by indexing track 50 (i.e., track or slot logic, indexing pattern) and pin 56 (e.g., detent, finger). For example, pin 56 may be on sleeve 54 and be positioned in the indexing track 50. Indexing track 50 may be embedded (e.g., formed, defined) on the outer surface of cycle mandrel 52. It will be understood by those skilled in the art that the movement of pin 56 and indexing track 50 is relative to on another. For example, in accordance to some embodiments the pin rotates with the sleeve and the indexing track axially moves with the cycle mandrel. In the depicted embodiment, cycle mandrel 52 is operationally connected to both of valves 36, 38 for example through tool operator 48 such that the axial movement of the cycle mandrel and the tool operator actuates the dual valves. Tool operator 48 is illustrated in FIG. 3 as a mechanical link that may be connected by a physical link to the valves and/or by a hydraulic or electrical connection. The illustrated and described arrangement of indexing device 40 is merely an example and different configurations can be utilized with indexing track 50.

Hydraulic pressure applied for example by pump 42 to annulus 34 (FIG. 1) is communicated to a first chamber 58 through a port 66 (FIG. 1). First chamber 58 may include a closed hydraulic circuit such as a pressure compensator. The applied pressure acts axially on cycle mandrel 52, for example downward in FIG. 3, and against spring 60 (e.g., gas, mechanical, hydraulic, etc.) to axially translate cycle mandrel 52 relative to sleeve 54, pin 56 and housing 62. When the applied hydraulic (i.e., fluid) pressure at first chamber 58 exceeds the spring 60 (i.e., reference pressure) force, cycle mandrel 52 moves axially in a first direction. When the applied signal pressure is bled down, the force of spring 60 causes cycle mandrel 52 to move in a second direction opposite from the first direction. The axial travel of cycle mandrel 52 is limited by the indexing track 50 and the pin 56. The length of travel and the direction of the axial travel of the cycle mandrel determine the operational position of both the lower valve 36 and upper valve 38 and thus the operational position of flow control device 12.

For example, in a first operational position of flow control device 12 the upper valve 38 is open and the lower valve 36 is closed. Lower valve 36 permits or blocks flow axially through the longitudinally extending bore 44 of flow control device 12 and upper circulating valve 38 permits or blocks radially flow between bore 44 and the exterior of the flow control device 12, e.g. housing 62, through ports 46. When the applied pressure signal is increased (positive pressure signal) the indexing track permits movement of the cycle mandrel and thus the tool operator in the first direction. As the cycle mandrel is moved axially in the first direction the lower valve is operated toward the closed position. At a second operating position of flow control device 12, which may be associated with an applied pressure range and range across an axial distance, both the lower and the upper valve are closed. To actuate flow control device 12 to a third operational position in which the lower valve is open and the upper valve is still closed, the applied pressure is increased over the second position pressure and the cycle mandrel is permitted to move into a third axial position relative to the sleeve. As further disclosed below one or more pressure cycles may be required to advance the pin into a sequence path of the indexing track 50 that permits the required axial movement of the cycle mandrel to actuate the flow control device from one operational position to another operational position.

FIGS. 4 through 11 illustrate flattened views of indexing tracks 50 in accordance to one or more aspects of the flow control device 12. Indexing track 50 is embodied by a J-slot (e.g., slots, grooves, elevations) formed in a geometric pattern, i.e. track, of interconnected pressure-up slots 78 and pressure-down slots 82. With additional reference to FIG. 1 through 3, indexing track 50 defines a sequence path for axially moving the cycle mandrel so as to operate flow control device 12 between operational positions. In accordance to aspects of the disclosure, the flow control device includes three operational positions. In the first or initial position the lower valve 36 is closed and the upper circulating valve 38 is open. In the second operational position, both the lower valve and the upper circulating valve are closed. In the third operational position of flow control device 12, the lower valve 36 is open and the upper circulating valve 38 is closed. Flow control valve 12 may be utilized for example in well testing operations.

Indexing track 50 defines a circumferential path connecting axially separated track positions 67, 69, and 71 each of which may be identified with a hold stop in the indexing track. Hold stops are positions in the track that do not permit the further axial movement in the direction opening upper circulating valve. This direction is referred to as the axial downward direction with reference to the depicted indexing tracks 50. It will be understood that the reference to axial movement up and down is relative to a particular configuration of the indexer and flow control valve and the disclosed indexer, track, and flow control device is not limited to a particular up or down orientation.

Each of the track positions 67, 69, and 71 is associated with a respective one of the operational positions of the flow control device 12. Accordingly, track positions 67, 69, and 71 each includes an axial length (e.g., section, portion) of the indexing track 50 that generally represents the respective operational position of flow control device 12 when the pin 56 is positioned in the track position.

The initial, or bottom, track position 67 is initiated at a lowest most point in the depicted indexing track 50 identified as hold stop 68. As will be understood in view of this disclosure, indexing track 50 may provide one or more hold stops within any particular track position. For example, the indexing track 50 illustrated in FIGS. 4-11 includes two hold stops 68, 68' in the bottom track position 67. In FIGS. 4-7, first hold stop 68 and second hold stop 68' are located at substantially the same axial position. In FIGS. 8-11 the second bottom hold stop 68' is located axially above the first bottom hold stop 68. In accordance to aspects of the disclosure, the flow control device 12 remains in the first operational position when pin 56 is in the first bottom hold stop 68, second bottom hold stop 68', or any other hold stop that is identified to be within the bottom track position 67. Similarly, mid-track position 69 may extend across an axial distance containing one or more mid-track hold stops 70. Similarly, third track position 71 may extend across an axial distance containing one or more third track hold stops 72.

Bottom track position 67 may extend from the lowest most hold stop 68 to an axial position prior to which flow control device 12 is actuated from the first operational position to the second operational position, i.e. upper circulating valve 38 is closed. The axial range of bottom track position 67, as well as the other track positions, can vary in accordance to the physical dimensions of the flow control device. Mid-track position 69 (e.g., region) may extend from a lowest most point above which upper circulating valve 38 is actuated closed, for example proximate to a lower most mid-track position hold stop 72, and extend to a position prior to which the flow control device is actuated from the second operational position to the third operational position, i.e., when lower valve 36 is opened. The third track position 71 may extend for example from a lowest most point above which lower valve 36 is actuated opened, for example proximate to a lower most top or third hold stop 72, and extend to an upper most or top position 73 of indexing track 50. For example, indexing track 50 may extend axially from a lower most hold stop 68 to an upper most position 73.

Figure 4:
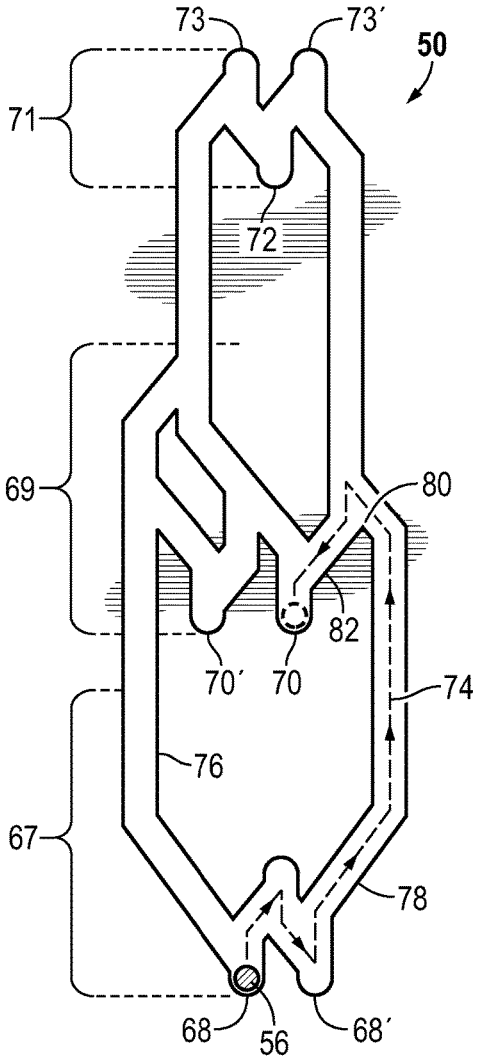
FIG. 4-11 are flattened views of indexing tracks in accordance to one or more aspects of the disclosure.
Figure 8:
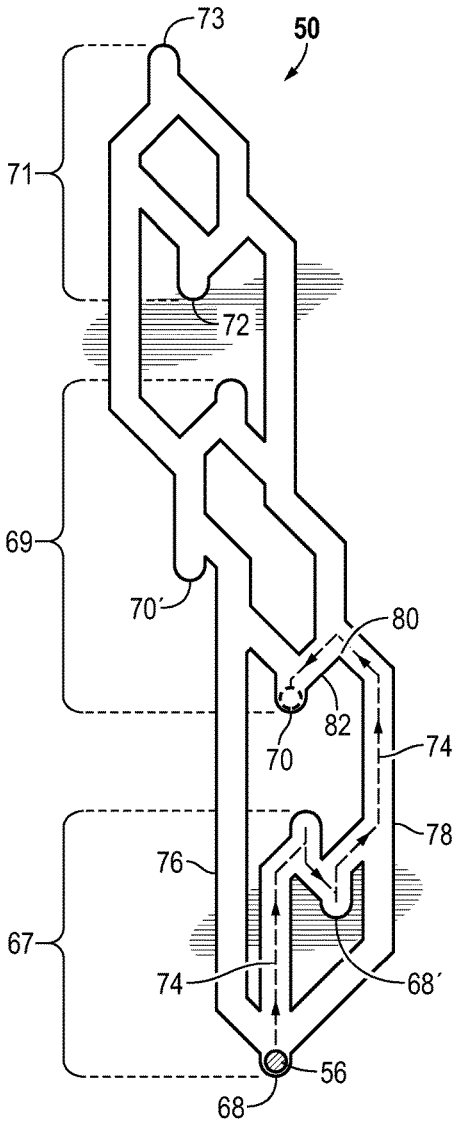

FIGS. 4 and 8 illustrate a pin 56 positioned in bottom track position 67 and at bottom most hold stop 68. Bottom track position 67 corresponds to the first operational position of flow control valve 12 in which the bottom valve 36, e.g., test valve, is closed and the upper circulation valve 38 is open. When pin 56 is located in the bottom most hold stop 68 the signal pressure being applied to indexer 40 does not exceed the force of spring 60, for example the signal pressure relative to the reference spring force is substantially zero. This may be because a signal pressure is not being applied, for example to annulus 34, or because the pressure signal has been bled down due to a leak in the well system 10 and/or completion 14.

Flow control device 12 can be operated to the second operational position, in which both valves 36, 38 are closed, by translating pin 56 axially in the first direction, up in FIGS. 4 and 8, to a second or mid-track position 69 which is initially identified with a first, or lowest most hold stop 70. The movement of pin 56 from bottom track position 67 to mid-track position 69 is illustrated in FIGS. 4 and 8 by the sequence path 74, which may be referred to as the upper circulating valve 38 closing path. It is again noted that reference to axial movement of pin 56 means relative movement of the pin and the indexing track. For example, in accordance to embodiments, cycle mandrel 52 and indexing track 50 move axially and pin 56 is axially stationary relative to the tool body, therefore the pin is axially moved relative to the indexing track. In accordance with one example, when cycle mandrel is moved in a first axial direction the pin is translated in the second axial direction relative to the indexing track. A positive pressure signal above the spring 60 force is applied to translate pin 56 axially up from the first bottom hold stop 68 and the release of the positive pressure signal, e.g., negative pressure signal, translates pin 56 down for example to a second bottom hold stop 68'. A second positive signal pressure is applied in excess of the spring 60 to move pin 56 axially in the first direction along a pressure-up sequence leg or slot 78 to a position above a transition point 80 from pressure-up slot 78 into pressure-down slot 82 that leads to mid-track hold stop 70. Upon release of the applied pressure pin 56 moves axially in the second direction to mid-track hold stop 70. Accordingly, the sequence path 74 from bottom track position 67 to mid-track position 69 is defined by one or more combinations of pressure-up slots 78 and pressure-down slots 82. Again, mid-track position 69 is associated with the second operating position of flow control device 12 with both of valves 36, 38 closed.

When pin 56 is in the mid-track section 69 both valves 36, 38 are closed. If an operator attempts to move the pin to the highest position 73 in a dual valve assembly to open the lower testing valve and there is a leak in the system, the indexer spring 60 will bias the pin 56 in the second direct to the lowest track position. It has been recognized that the pin can be moved to the bottom track position 67 and the circulating valve unintentionally opened prior to the leak being recognized. In accordance to aspects of indexing track 50, pressure-up slot 85 (FIGS. 5, 9) is axially offset from pressure-down return slot 76, accordingly pin 56 cannot translate continuously in the second direction from pressure-up slot 85 to the first track position 67. For example, a mid-track hold stop is located between the bottom track position 67 and the pressure-up slot 85 (FIGS. 5, 9) that extends from the mid-track position 69 to the upper most position 73 thereby preventing pin 56 from inadvertently moving back to the bottom track position 67 if the signal pressure (e.g., annulus pressure 34) is lost, e.g. a leak, when pin 56 is in the pressure-up slot 85 of the lower valve opening sequence path. In accordance to aspects of indexing track 50, pin 56 is prevented or limited from moving axially in the second direction to bottom track position 67 from either of the mid-track position 69 or the top track position 71 unless pin 56 is cycled into a pressure-down return slot 76 (e.g., circulating valve opening sequence path).

Figure 5:
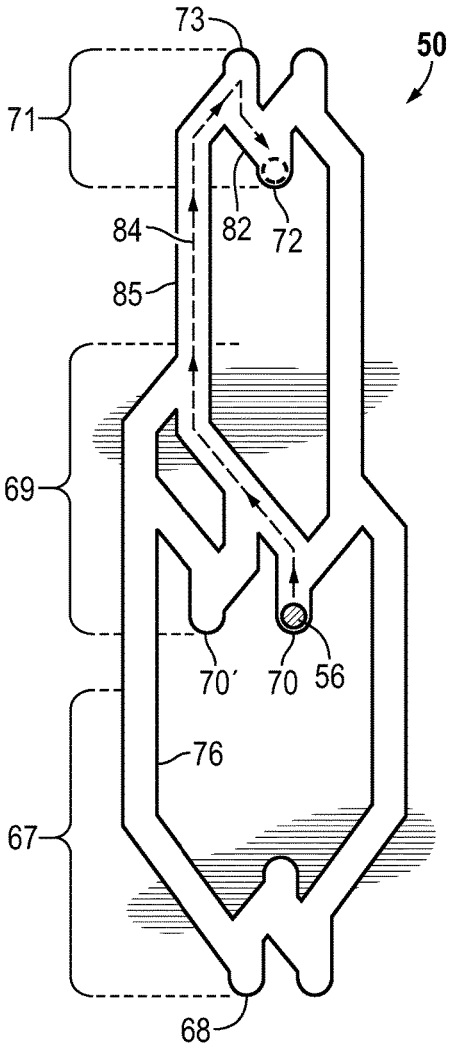
Figure 9:
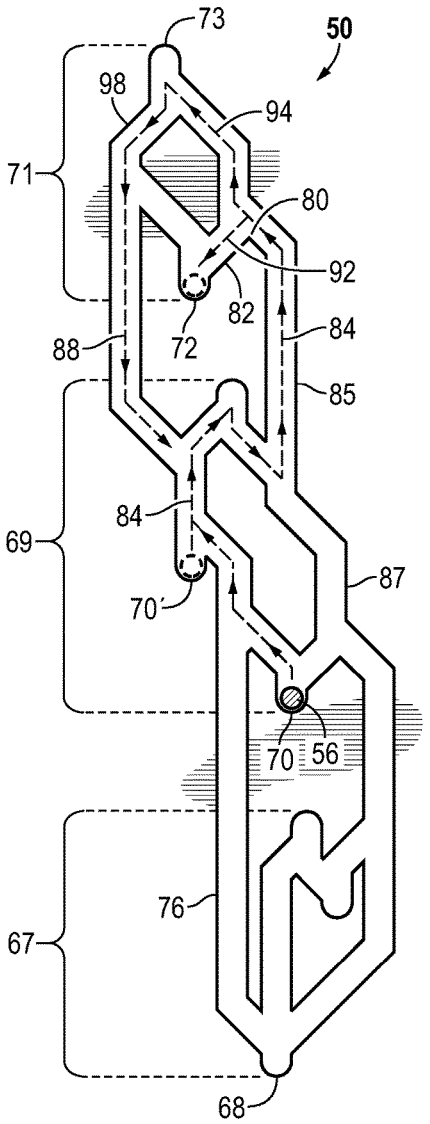

With reference to FIGS. 5 and 9, indexing track 50 defines a lower valve 36, e.g., test valve, opening sequence path 84 across which pin 56 moves from mid-track position 69 to upper most position 73 and into third track position 71. In FIG. 5, lower valve opening sequence path 84 extends from mid-track hold stop 70 into and along the pressure-up slot 85 extending to upper most position 73. If applied pressure is lost while pin 56 is in pressure-up slot 85 the pin will move in the second direction and movement will be stopped for example at second mid-track hold stop 70'. In FIG. 9, lower valve opening sequence path 84 extends from a first lower most mid-track hold stop 70 in the first direction to a second mid-track hold stop 70' and through a pressure cycle path into pressure-up slot 85 to the upper most position 73. Again, if pressure is lost while pin is in the pressure-up slot 85 portion of sequence path 84 then the pin will move back in the second direction along slot 85 and along an alternate slot 87 extending from slot 85 to first mid-track hold stop 70.

With reference to FIG. 9, the depicted lower valve opening sequence path 84 includes a third position hold sequence path 92 and a hold bypass sequence path 94. Lower valve opening sequence path 84 extends axially along a pressure-up slot 85 to top position 73 which is located axially above transition point 80 into a pressure-down slot 82 that leads to upper hold stop 72. In operation, the applied pressure may be reduced when pin 56 is located axially above the transition point 80 into the pressure-down slot that defines the upper hold sequence path 92 thereby moving pin 56 to third hold stop 72 whereby lower valve 36 will be held open. In accordance to aspects, the pin 56 can be translated across hold bypass sequence path 94 by skipping the pressure-down sequence at third position hold sequence path 92 and continuing movement of pin 56 along a pressure-up slot 85 bypass sequence path 94 to upper most position 73 and pressuring down the applied pressure signal when pin 56 is at upper most position 73 translating the pin into the pressure-down slot identified as lower valve closing slot 98, which is illustrated terminating at second mid-track hold stop 70'. Utilizing hold bypass sequence path 94 allows the operator to open lower valve 36 and cycle the pressure-down to close lower valve 36, for example with pin located at second hold stop 70'. Utilizing hold bypass sequence path 94 reduces a pressure cycle relative to cycling across third position hold sequence path 92. For example, proceeding across hold sequence path 92 requires a pressure cycle moving pin 56 from the third hold stop 72 into the lower valve closing slot 98.

Figure 6:
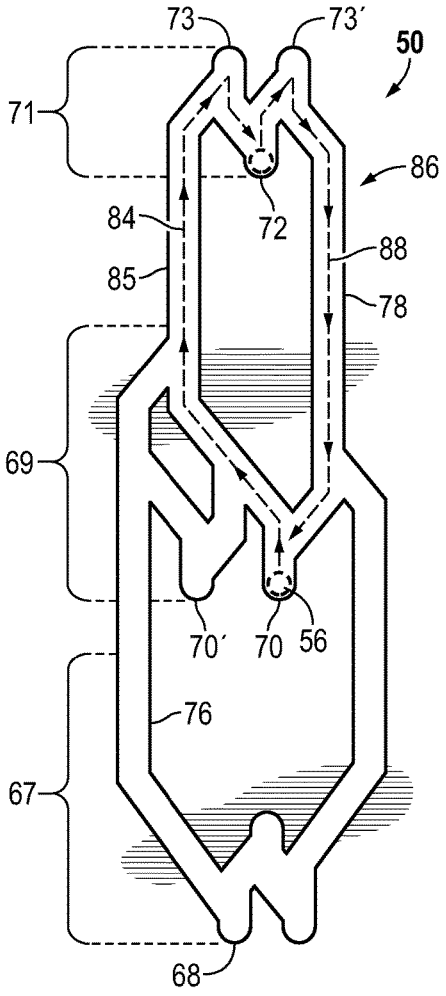
Figure 10:
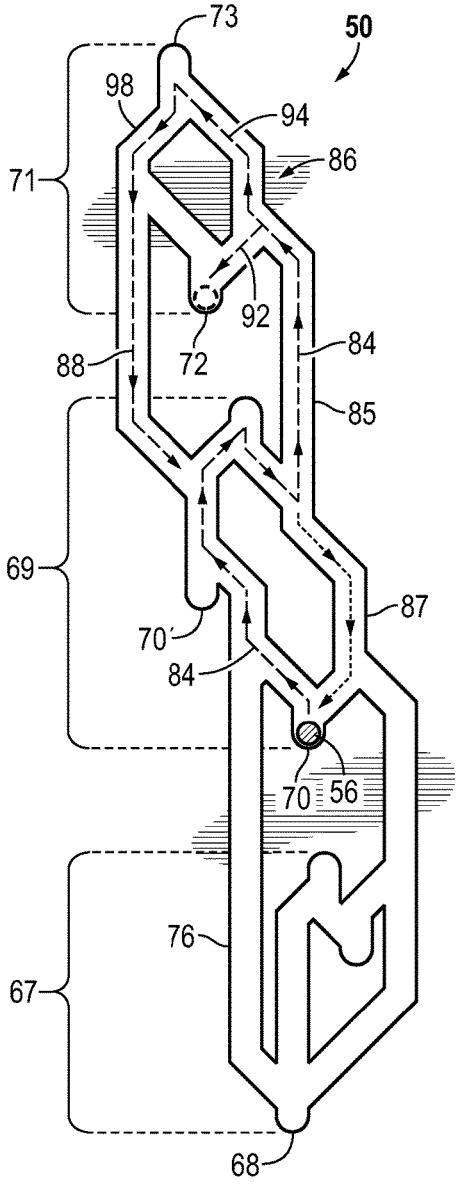

In accordance with some aspects, indexing track 50 provides a continuous sequence loop 86, e.g. testing loop, permitting flow control device 12 to be operated repeatedly between the second and third operational positions, thereby repeatedly opening and closing lower valve 36 without opening upper circulating valve 38. FIG. 6 illustrates a continuous sequence loop 86 including lower valve opening sequence path 84 and lower valve 36 closing sequence path 88 extending through a pressure-down slot 78 in the axial direction from third track position 71 to second or mid-track position 69. FIG. 10 illustrates a continuous sequence loop 86 including lower valve opening sequence path 84 and lower valve closing sequence path 88.

Figure 7:
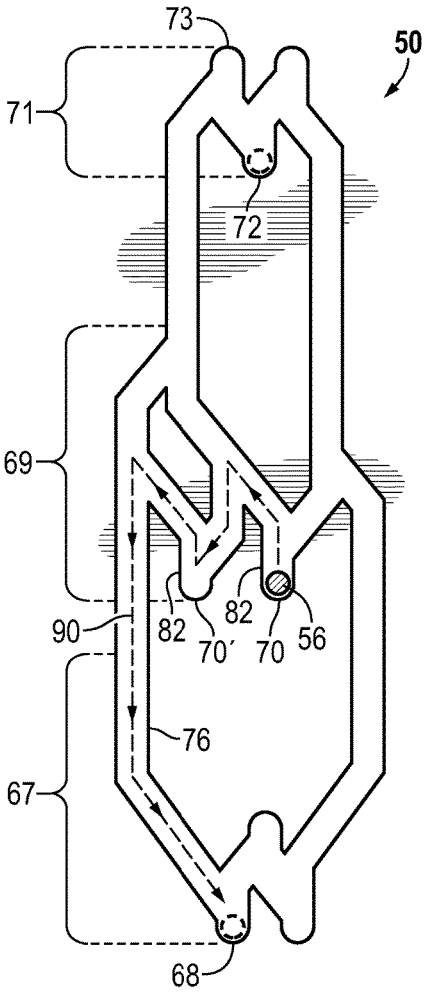

Flow control device 12 is actuated to the first position by cycling pin 56 to the first track position 67, for example, to a first position hold stop. With reference to FIG. 7, depicted indexing track 50 provides a double pressure pulse or cycle sequence path to move pin 56 into circulating valve closing slot 76 once pin 56 has been moved to the second track position 69. In this example, the circulating valve closing sequence path 90 is initiated with pin 56 in a first mid-track hold stop 70. A first pressure cycle moves pin 56 along a first pressure-up slot and a first pressure-down slot moves pin 56 to second mid-track hold stop 70'. A second pressure cycle moves pin 56 along a second pressure-up slot and then into the pressure-down return or circulating valve closing slot 76. Establishing an additional pressure pulse cycle to actuate flow control device 12 to the first position thereby opening upper circulating valve 38 reduces the risk of unintentionally opening the circulating valve.

Figure 11:
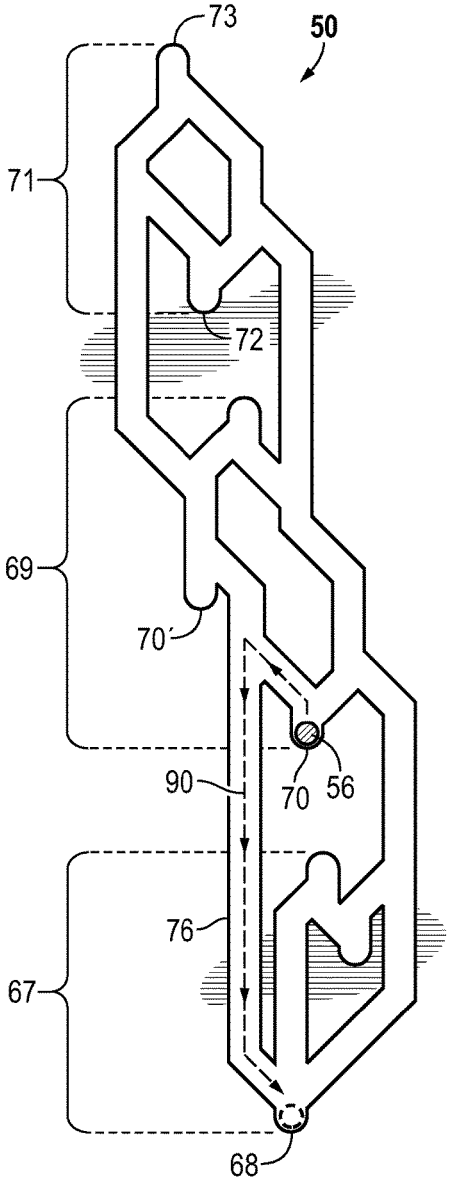

With reference to FIG. 11, the depicted indexing track 50 provides a single pressure cycle to move pin 56 from the mid-track position 69 to first track position 67. For example, from mid-track hold stop 70 a pressure-up signal translates pin 56 through a pressure-up slot and into return slot 76 and upon release of the pressure-up signal the spring bias pin 56 to the first track position 67 thereby actuating upper circulating valve 38 to the open position and flow control valve 12 to the first position.

With reference to FIGS. 1-11, a method includes deploying a flow control device in a wellbore on a conveyance having a longitudinally extending bore, the flow control device including a first valve connected with the bore to control axial flow through the bore and a second valve connected with the bore to control radial flow between the bore and an exterior, and an indexer device coupled to the first valve and the second valve, including a pin moveable in response to a pressure signal along an indexing track having a plurality of interconnected pressure-up and pressure-down slots that define sequence paths to translate the pin and to actuate the flow control device to a first position when the pin is in a first track position, to a second position when the pin is in a mid-track position, and a third position when the pin is in a third track position. The method includes translating the pin in a first axial direction from the first track position to the mid-track position, translating the pin in the first axial direction from the mid-track position to the third track position, translating the pin in a second axial direction from the third track position to the mid-track position, and translating the pin across a return sequence path from the mid-track position to the first track position.

In accordance to one or more methods, in the first position the first valve is closed and the second valve is open, in the second position the first valve is closed and the second valve is closed and in the third position the first valve is open and the second valve is closed.

The indexing track may include a third position pressure-up slot 85 extending in a first axial direction from the mid-track position 69 to the third track position 71, and a mid-track hold stop positioned axially between the third position pressure-up slot 85 and the first track position 67. The mid-track hold stop blocks axial movement of the pin in the axial direction from the third position pressure-up slot to the first track position.

The indexing track defines a return sequence path to translate the pin from the mid-track position to the first track position. In accordance to some aspects the return sequence path may include two pressure-up slots and translating the pin includes applying two positive, e.g., pressure-up, signals.

In accordance to some aspects, the indexing track includes a third position pressure-up slot 85 extending in the first axial direction from the mid-track position 69 to an upper most position 73 of the third track position 71, a third position pressure-down slot 98 extending in the second axial direction from the upper most position to the mid-track position, a hold stop sequence path 92 interconnecting the third position pressure-up slot and the third position pressure-down slot and a third position hold stop 72 located on the hold stop sequence path. In accordance to some aspects the flow control device is operated by translating the pin though the third position pressure-up slot to the upper most position bypassing the hold stop sequence path and then translating the pin from the upper most position through the third position pressure-down slot to the mid-track position.

The foregoing outlines features of several embodiments of pressure cycle independent indexers, methods, tools and systems so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A flow control device, the device comprising:

a housing having a longitudinally extending bore;

a first valve connected with the bore to control axial flow through the bore;

a second valve connected with the bore to control radial flow between the bore and exterior of the housing;

a mandrel operably coupled to the first valve and the second valve, the mandrel axially moveable in response to a pressure signal; and an indexer device coupled with the mandrel, including a pin moveable along an indexing track in response to the pressure signal, the indexing track comprising a plurality of interconnected pressure-up slots and pressure-down slots that define sequence paths to translate the pin and to actuate the flow control device to a first position when the pin is in a first track position, to a second position when the pin is in a mid-track position, and a third position when the pin is in a third track position, wherein in the first position the first valve is closed and the second valve is open;

in the second position the first valve is closed and the second valve is closed; and in the third position the first valve is open and the second valve is closed.

2. The device of claim 1, wherein the indexing track comprises:

a third position pressure-up slot extending in a first axial direction from the mid-track position to the third track position; and a mid-track hold stop positioned axially between the third position pressure-up slot and the first track position, the mid-track hold stop blocking axial movement of the pin in a second axial direction from the third position pressure-up slot to the first track position.

3. The device of claim 1, wherein the indexing track comprises a return sequence path to move the pin from the mid-track position to the first-track position, wherein the return sequence path comprises two pressure-up slots.

4. The device of claim 1, wherein the indexing track comprises:

a third position pressure-up slot extending in a first axial direction from the mid-track position to the third track position;

a mid-track hold stop positioned axially between the third position pressure-up slot and the first track position, the mid-track hold stop blocking axial movement of the pin in a second axial direction from the third position pressure-up slot to the first track position; and a return sequence path to move the pin from the mid-track position to the first track position, wherein the return sequence path comprises two pressure-up slots.

5. The device of claim 1, wherein the indexing track comprises:

a third position pressure-up slot extending in a first axial direction from the mid-track position to an upper most position of the third track position; and a third position pressure-down slot extending in a second axial direction from the upper most position to the mid-track position.

6. The device of claim 1, wherein the indexing track comprises:

a third position pressure-up slot extending in a first axial direction from the mid-track position to the third track position;

a mid-track hold stop positioned axially between the third position pressure-up slot and the first track position, the mid-track hold stop blocking axial movement of the pin in a second axial direction from the third position pressure-up slot to the first track position; and a third position pressure-down slot extending in a second axial direction from the upper most position to the mid-track position.

7. The device of claim 1, wherein the indexing track comprises:

a third position pressure-up slot extending in a first axial direction from the mid-track position to an upper most position of the third track position;

a third position pressure-down slot extending in a second axial direction from the upper most position to the mid-track position;

a hold stop sequence path interconnecting the third position pressure-up slot and the third position pressure-down slot; and a third position hold stop located on the hold stop sequence path.

8. The device of claim 1, wherein the indexing track comprises:

a third position pressure-up slot extending in a first axial direction from the mid-track position to the third track position;

a mid-track hold stop positioned axially between the third position pressure-up slot and the first track position, the mid-track hold stop blocking axial movement of the pin in a second axial direction from the third position pressure-up slot to the first track position;

a third position pressure-down slot extending in the second axial direction from the upper most position to the mid-track position;

a hold stop sequence path interconnecting the third position pressure-up slot and the third position pressure-down slot; and a third position hold stop located on the hold stop sequence path.

9. A method, comprising:

utilizing a flow control device that is deployed in a wellbore on a conveyance having a longitudinally extending bore, the flow control device comprising:

a first valve connected with the bore to control axial flow through the bore, a second valve connected with the bore to control radial flow between the bore and an exterior;

a mandrel operably coupled to the first valve and the second valve, the mandrel axially moveable in response to a pressure signal; and an indexer device coupled with the mandrel, including a pin moveable along an indexing track in response to the pressure signal, the indexing track comprising a plurality of interconnected pressure-up slots and pressure-down slots that define sequence paths to translate the pin and to actuate the flow control device to a first position when the pin is in a first track position, to a second position when the pin is in a mid-track position, and a third position when the pin is in a third track position, wherein in the first position the first valve is closed and the second valve is open;

in the second position the first valve is closed and the second valve is closed; and in the third position the first valve is open and the second valve is closed;

translating the pin in a first axial direction from the first track position to the mid-track position;

translating the pin in the first axial direction from the mid-track position to the third track position;

translating the pin in a second axial direction from the third track position to the mid-track position; and translating the pin across a return sequence path from the mid-track position to the first track position.

10. The method of claim 9, wherein the indexing track comprises:

a third position pressure-up slot extending in a first axial direction from the mid-track position to the third track position; and a mid-track hold stop positioned axially between the third position pressure-up slot and the first track position, the mid-track hold stop blocking axial movement of the pin in a second axial direction from the third position pressure-up slot to the first track position.

11. The method of claim 9, wherein the translating the pin across a return sequence path from the mid-track position to the first track position comprises applying two pressure-up pressure signals.

12. The method of claim 9, wherein the translating the pin across a return sequence path from the mid-track position to the first track position comprises applying two pressure-up pressure signals; and wherein the indexing track comprises:

a third position pressure-up slot extending in a first axial direction from the mid-track position to the third track position; and a mid-track hold stop positioned axially between the third position pressure-up slot and the first track position, the mid-track hold stop blocking axial movement of the pin in a second axial direction from the third position pressure-up slot to the first track position.

13. The method of claim 9, comprising translating the pin in the first axial direction from the mid-track position to an upper most position of the third track position and translating the pin in the second axial direction from the upper most position to the mid-track position without locating the pin in a hold stop in the third track position.

14. The method of claim 9, wherein the indexing track comprises:

a third position pressure-up slot extending in the first axial direction from the mid-track position to an upper most position of the third track position;

a third position pressure-down slot extending in the second axial direction from the upper most position to the mid-track position;

a hold stop sequence path interconnecting the third position pressure-up slot and the third position pressure-down slot; and a third position hold stop located on the hold stop sequence path.

15. The method of claim 14, further comprising:

translating the pin though the third position pressure-up slot to the upper most position bypassing the hold stop sequence path; and translating the pin from the upper most position through the third position pressure-down slot to the mid-track position.

* * * * *